US006550910B2

(12) United States Patent
Hwang

(10) Patent No.: US 6,550,910 B2
(45) Date of Patent: Apr. 22, 2003

(54) IMAGING DEVICE WITH INTERFACE FEATURES

(75) Inventor: Peter G. Hwang, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/932,360

(22) Filed: Aug. 16, 2001

(65) Prior Publication Data

US 2003/0035040 A1 Feb. 20, 2003

(51) Int. Cl.[7] ..... B41J 29/13

(52) U.S. Cl. ..... 347/108; 361/680; 361/681; 361/682; 361/683

(58) Field of Search ..... 347/108; 346/41; 400/691, 693, 703, 711; 361/610, 681, 680, 682, 683; 700/17

(56) References Cited

U.S. PATENT DOCUMENTS 5,481,645 A * 1/1996 Bertino et al. ..... 395/2.79

6,388,871 B1 * 5/2002 Masui ..... 361/683

OTHER PUBLICATIONS

Hewlett–Packard Company, "HP Photosmart 1215/1218 User's Guide", 2000, Chapters 1 and 3, pp. 1–7 and pp. 29–37.

Kodak Personal Picture Maker 200 by Lexmark, "User's Guide", 2000, Chapters 2 and 3, pp. 13–17, 21–32.

* cited by examiner

*Primary Examiner*—Thinh Nguyen
*Assistant Examiner*—Ly T Tran
(74) *Attorney, Agent, or Firm*—Charles F. Moore

(57) ABSTRACT

An imaging device includes a panel having a first set of interface features located on a first surface of the panel and a second set of interface features located on a second surface of the panel. The first surface of the panel is accessible and the second surface of the panel is concealed from view when the panel is in a novice position.

7 Claims, 2 Drawing Sheets

IMAGING DEVICE WITH INTERFACE FEATURES

TECHNICAL FIELD

The present invention relates generally to the electronics field and, more particularly, to an imaging device with interface features.

BACKGROUND

Imaging devices such as personal printers for the home user have become pervasive in recent years. The functionality and capabilities of these devices have also steadily increased, while their cost of ownership has decreased.

As digital photography has grown in popularity, so has the use of personal imaging devices to print digital images. An example of a personal printer that is adapted for printing digital images is the PhotoSmart® 1215 ink jet printer manufactured by Hewlett-Packard Co. One feature of the PhotoSmart 1215 printer allows a user to transfer digital images directly to the printer from a portable memory card, digital camera or other mobile device without utilizing a personal computer. To allow a user to control the transfer and printing of digital images directly from a mobile device or memory card, the 1215 printer includes nine input buttons and an LCD text screen on a front portion of the printer that faces the operator. The nine buttons allow a user to perform basic printing control functions, such as power on/off and cancel printing, as well as more advanced digital image control functions, such as selecting, editing and manipulating digital photos for printing. The 1215 printer also includes an infrared port on the front panel of the printer and two memory card slots on the side of the printer next to the input buttons. These memory card slots accept CompactFlash and SmartMedia portable memory cards.

Imaging devices such as the PhotoSmart 1215 printer are often found in homes that include users with a wide range of computer skills. Some users in the home will utilize many of the advanced features of the printer, while other more inexperienced users may be capable of using the printer only for traditional printing purposes, such as printing documents, web pages, etc. from a personal computer. For these novice users, a complex user interface on the printer can prove intimidating and confusing, particularly when their need may be only to cycle power or to cancel a print request. The front panel of the 1215 printer with its nine different buttons and LCD display is an example of a user interface that can be difficult for a novice user to negotiate.

SUMMARY OF THE INVENTION

An imaging device includes a panel having a first set of interface features located on a first surface of the panel and a second set of interface features located on a second surface of the panel. The first surface of the panel is accessible and the second surface of the panel is concealed from view when the panel is in a novice position.

Other features of the present invention will become apparent upon examination of the following drawings and detailed description. It is intended that all such additional features and advantages be included herein within the scope of the present invention.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION OF THE INVENTION

Figure 1:
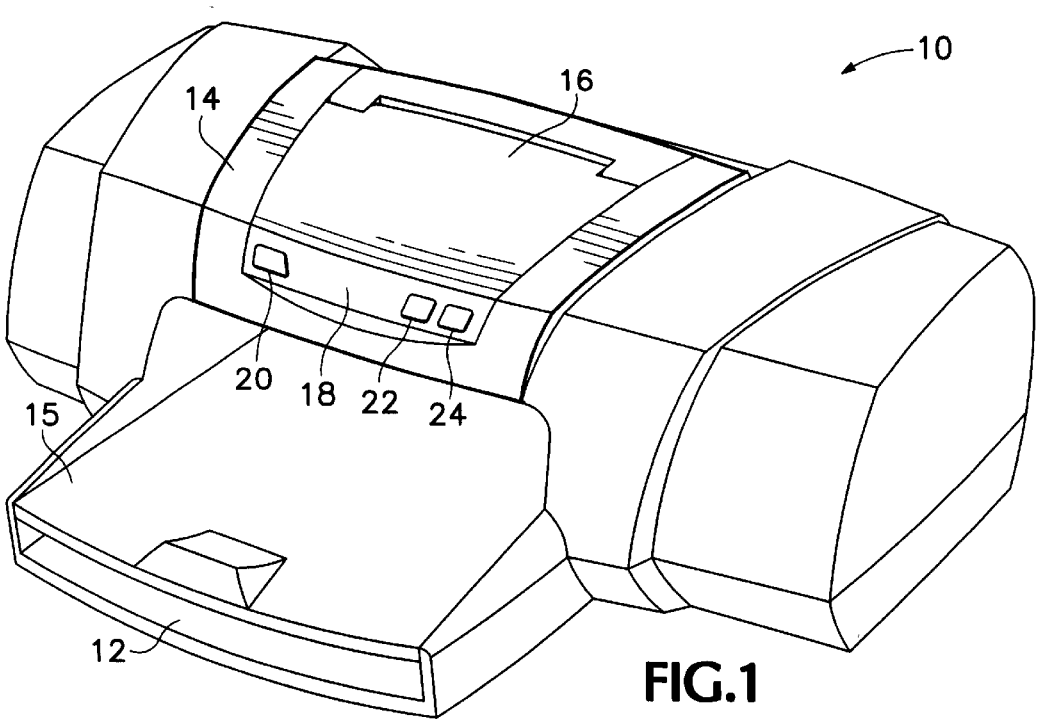
FIG. 1 is a perspective view of one embodiment of an imaging device of the present invention showing a panel in a novice position.

FIG. 1 illustrates an embodiment of the imaging device of the present invention. The imaging device shown in FIG. 1 is an ink jet printer 10. It will be appreciated that the present invention may be embodied in a wide variety of other types of imaging devices, including but not limited to electrophotographic printers, facsimile machines, scanners and the like.

In general, the ink jet printer 10 operates by utilizing one or more ink jet pens (not shown) to eject ink onto a sheet of media. The printer 10 includes a media tray 12 for storing and supplying the media sheets to an internal media handling mechanism (not shown). As a media sheet is printed it is moved from the internal media handling mechanism into an output tray 15. The printer 10 also includes a top surface 14 that may pivot open to allow access to the ink jet pens and media handling mechanism inside the printer.

In accordance with the present invention, the top surface 14 of the printer 10 also includes a panel 16. As shown in FIG. 1, the panel 16 includes a first surface 18 on which a first set of interface features are located. In the preferred embodiment, the first set of interface features includes a power control button 20, a cancel button 22 and a paper advance button 24. In FIG. 1 the panel 16 is substantially flush with the top surface 14 of the printer 10, thereby making the power control button 20, the cancel button 22 and the paper advance button 24 easily accessible to an operator of the printer. For purposes of description, this position of the panel 16 will be referred to as the novice position of the panel. Advantageously, when the panel 16 is in the novice position, a novice or inexperienced user is presented only with the first set of interface features that control basic functionality of the printer.

Figure 2:
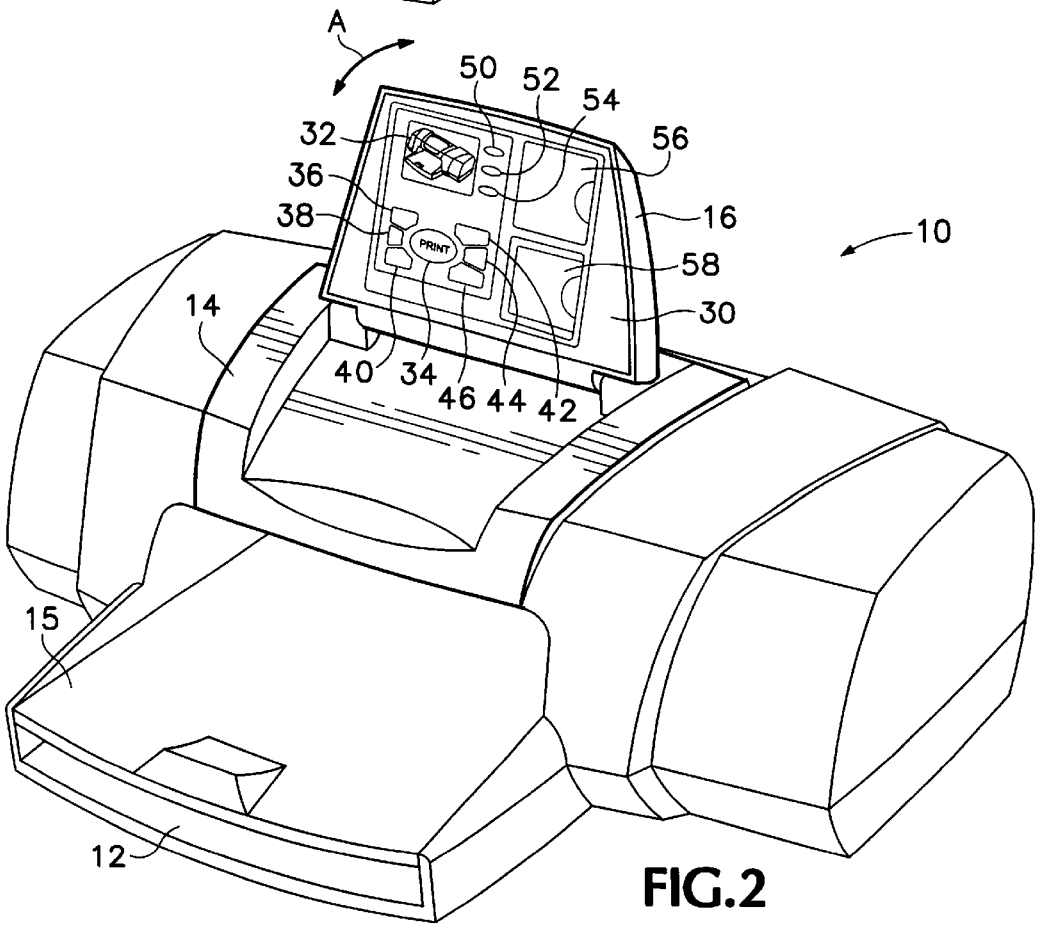
FIG. 2 shows the imaging device of FIG. 1 with the panel in an advanced position.

With reference now to FIGS. 1 and 2, the panel 16 may be rotated upwardly by an operator to bring into view a second surface 30 containing a second set of interface features. In viewing FIGS. 1 and 2, it will be appreciated that the second surface 30 and second set of interface features are concealed from view when the panel 16 is in the novice position, thereby keeping these additional interface features from potentially confusing an inexperienced operator. With reference now to FIG. 2, this position of the panel 16 in which the second surface 30 and second set of interface features are accessible to an operator will be referred to as the advanced position.

Figure 3:
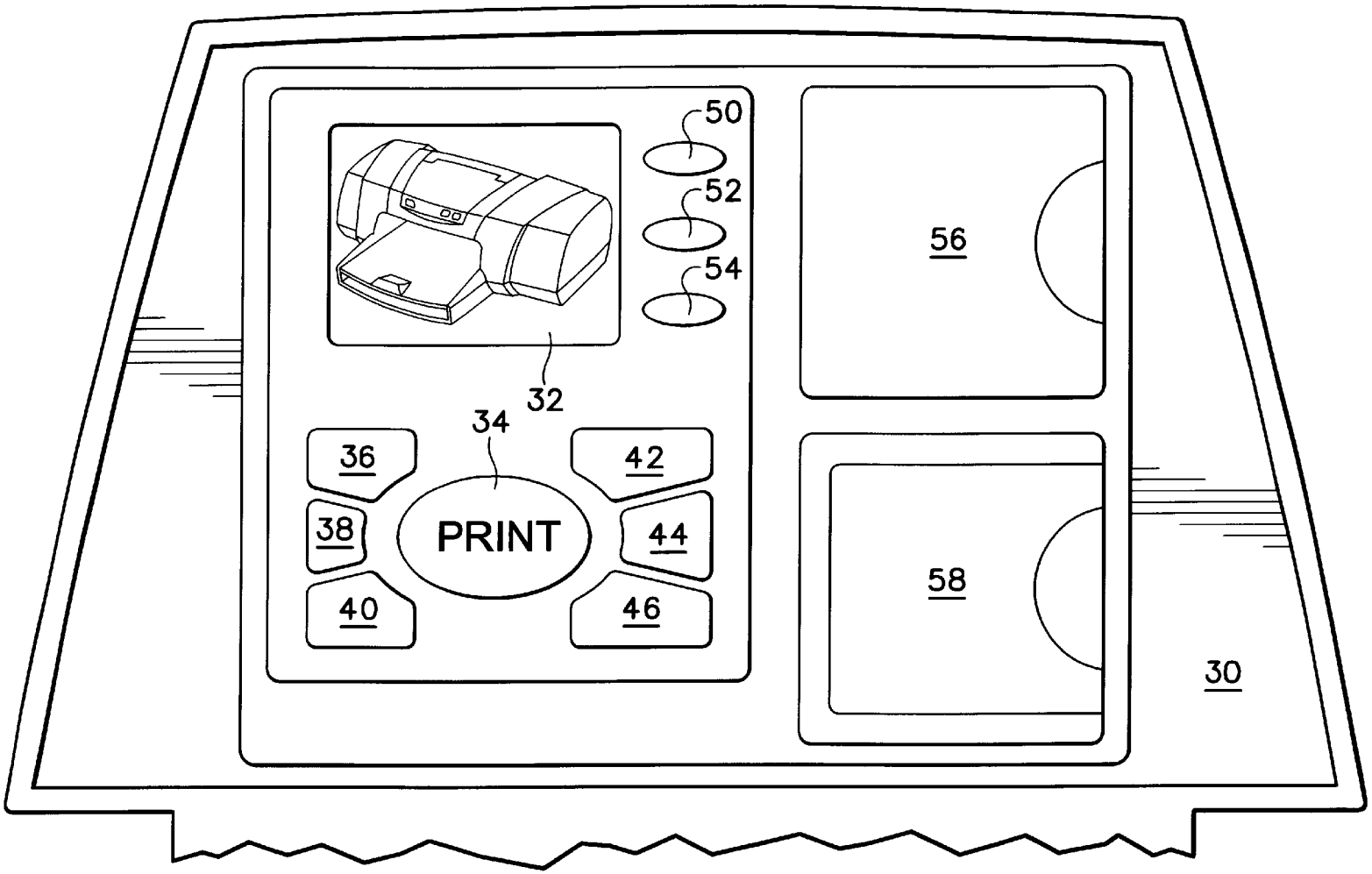
FIG. 3 is an enlarged view of the second set of interface features on the second surface of the panel of the imaging device of FIG. 1.

In the preferred embodiment, the second set of interface features includes image control features for manipulating digital images. More specifically, as shown in FIGS. 2 and 3, the image control features may include a display 32, such as a color LCD display, for presenting images and information to an operator. The image control features may also include means for inputting commands to manipulate digital images. The means for inputting commands may include a print button 34, menu button 36, a tools button 38, a select button 40, a view/return button 42, an exit button 44 and a save button 46. Utilizing these image control features, an operator may manipulate and edit digital images in various manners. For example, an operator may use the image control features to adjust the color and size of an image, crop and rotate the image, reduce red-eye in an image, add a border and text, copy images to another memory source, select a number of copies to be printed, place multiple images on a single page and preview and scroll through multiple images.

The second set of interface features may also include the same basic printer functionality control buttons as found on the first surface 18, namely a power control button 50, a cancel button 52 and a paper advance button 54.

The second set of interface features may also include at least one receptacle for receiving a portable memory device. In the preferred embodiment the second surface 30 includes a first memory card receptacle 56 and a second memory card receptacle 58. As an example, the first memory card receptacle 56 may receive CompactFlash memory cards and the second memory card receptacle 58 may receive SmartMedia memory cards. With reference to FIGS. 1 and 2, it will be appreciated that the first and second memory card receptacles 56, 58 are also concealed from view when the panel 16 is in the novice position.

With reference now to FIG. 2, it will be appreciated that the panel 16 is substantially upright in the advanced position. In this position the panel 16 may also be pivoted in the direction of action arrow A to adjust the presentation angle to the operator. Advantageously, this allows an operator to position the panel 16 for optimum viewing of the display 32.

Many variations and modifications may be made to the above-described embodiment(s) of the invention without departing substantially from the spirit and principles of the invention. All such modifications and variations are intended to be included herein within the scope of the present invention.

What is claimed is:

1. An imaging device having a panel, comprising:

a first set of interface features located on a first surface of the panel including a power control feature, a cancel feature and a paper advance feature;

a second set of interface features located on a second surface of the panel; and the first surface being accessible and the second surface being concealed from view when the panel is in a novice position.

2. An imaging device having a panel, comprising:

a first set of interface features located on a first surface of the panel;

a second set of interface features located on a second surface of the panel including image control features for manipulating digital images, the image control features including a display and means for inputting commands; and the first surface being accessible and the second surface being concealed from view when the panel is in a novice position.

3. An imaging device having a panel, comprising:

a first set of interface features located on a first surface of the panel;

a second set of interface features located on a second surface of the panel including at least one receptacle for receiving a portable memory device; and the first surface being accessible and the second surface being concealed from view when the panel is in a novice position.

4. The imaging device of claim 3, wherein the receptacle is concealed from view when the panel is in the novice position.

5. A digital image manipulation component mounted to an imaging device, comprising:

first means for inputting commands to the imaging device, the first means for inputting commands including a power control feature, a cancel feature and a paper advance feature;

second means for inputting commands to the imaging device; and the first means for inputting commands being accessible and the second means for inputting commands being concealed from view when the digital image manipulation component is in a novice position.

6. A digital image manipulation component mounted to an imaging device, comprising:

first means for inputting commands to the imaging device;

second means for inputting commands to the imaging device, the second means for inputting commands including at least one receptacle for receiving a portable memory device; and the first means for inputting commands being accessible and the second means for inputting commands being concealed from view when the digital image manipulation component is in a novice position.

7. The digital image manipulation component of claim 6, wherein the receptacle is concealed from view when the movable panel is in the novice position.

* * * * *